US007325416B2

(12) United States Patent
Bernsen

(10) Patent No.: US 7,325,416 B2
(45) Date of Patent: Feb. 5, 2008

(54) GEM SETTING

(76) Inventor: Roger M. Bernsen, 3030 SW. 144th Ter., Davie, FL (US) 33330

( * ) Notice: Subject to any disclaimer, the term of this patent is extended or adjusted under 35 U.S.C. 154(b) by 0 days.

(21) Appl. No.: 10/708,527

(22) Filed: Mar. 10, 2004

(65) Prior Publication Data

US 2005/0199004 A1 Sep. 15, 2005

(51) Int. Cl.
*A44C 17/02* (2006.01)

(52) U.S. Cl. ..... 63/27

(58) Field of Classification Search ..... 63/26, 63/27, 29.1, 30; 29/10, 896.4, 896.41, 896.412
See application file for complete search history.

(56) References Cited

U.S. PATENT DOCUMENTS 1,182,534 A * 5/1916 Driggott ..... 63/29.1
1,712,171 A * 5/1929 Rochas ..... 63/29.1
3,670,524 A * 6/1972 Korwin ..... 63/18
6,629,434 B2 * 10/2003 Chia et al. ..... 63/26

* cited by examiner

*Primary Examiner*—Jack W. Lavinder
(74) *Attorney, Agent, or Firm*—Malin, Haley & DiMaggio, P.A.

(57) ABSTRACT

A method and stone mount for an inside bezel mounting that improves precisely calculating the bezel face angle and contiguous finish on the inside bezel face for enhanced light brilliance that includes mounting the stone from the bottom up using a retaining spring. The stone once inserted into the mounting stops at the bezel lip then the retaining spring once fully inserted can be permanently affixed by bending the countersunk prongs over said retaining spring thus completing the setting.

4 Claims, 4 Drawing Sheets

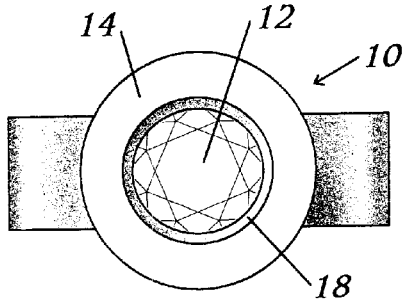
Fig. 1a
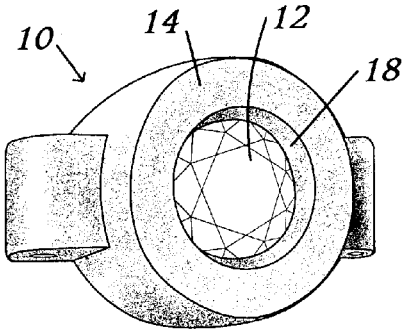
Fig. 1b
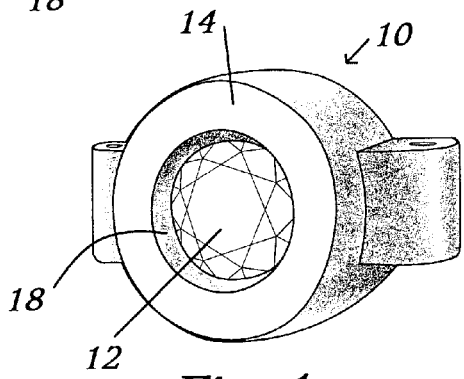
Fig. 1c
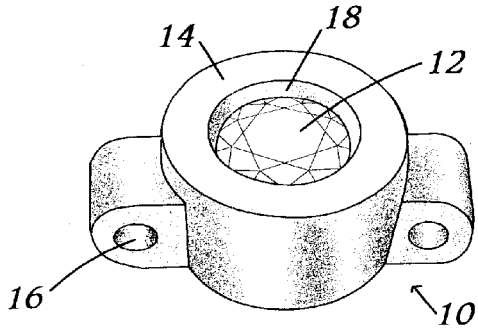
Fig, 1d

GEM SETTING

BACKGROUND OF INVENTION

1. Field of the Invention

This invention relates to an improved gem or synthetic stone setting for an inside bezel mounting that results in considerable time and cost savings in order to provide a precisely calculated bezel angle face and contiguous finish on the inside bezel face for enhanced light brilliance.

2. Description of Related Art

In the world of setting stones, either gem stones or synthetic stones, for an inside bezel setting, conventionally the stones were mounted from the top down. The conventional gem setting for an inside bezel setting is expensive and time consuming due to the difficult task of trying to maximize the refractive light out or in to the crown of the stone. The present invention dramatically improves the setting for either gem or synthetic stones (regardless of their shapes) for the inside bezel mounting. The present invention provides a major aesthetic advantage of pre-establishing the bezel angle face which can be precisely calculated and maximized for refracted light out or reflected light in through the crown of the stone before permanently completing the setting.

SUMMARY OF INVENTION

The present invention is an improved setting for either gem or synthetic stones, round, oval or pear-shaped either faceted or cabochon utilizing the aesthetic and inherently protective (shielding) properties associated with the classic inside bezel mounting. The invention, self-centering setting provides for the stone to be permanently set with minimum risk to the stone during the actual setting process. Additional advantages associated with the present invention are the considerable labor and time savings, resulting in reduced costs, reduced breakage and more importantly providing a cost effective method to obtain the predictable angle and contiguous finish on the inside bezel face. This action can be accomplished by finishing and polishing the bezel face pre-stone setting which previously was an impossible task due to the nature of the top down inside bezel setting techniques. The major aesthetic advantage of pre-establishing this bezel angle face is that this angle can be precisely calculated thus maximized for the refracted light out or the reflected light in through the crown of the stone using the present invention.

In the present art of inside bezel setting, stones are mounted and set from the top down. As for round stones, the process typically involves drilling a hole approximately ⅔ the diameter of the stone and then cutting a seat the diameter of stone at a depth commensurate with the table sitting flush with the top of the mounting. The seat and/or new bearing surfaces are at a pitch, which reflects the pavilion angles and/or the lower half of the stone.

After the stone is placed into its seat from above, the metal corner at the top of what was of the open cylinder is then "hammered" down in a series of progressive spiral rotations. Through each rotation, the metal spreads in the direction of the center of the interior forming the bezel. This action effectively terminates at the crown of the stone typically reducing the interior diameter by 10%. The result is covering the stone and preventing the stone from coming out of its setting. The bezel is then carefully trimmed at the stone and metal interface paying particular attention not to nick and damage the stone, then polished to blend the peens from hammering.

Additionally, it should be noted that there are other styles included in the present art of stone setting. The most popular are "prong" and their variations, two, three, four, six or more prongs. This popularity is due primarily to the manufacturing considerations and the associative costs.

Currently, prong settings are the least labor consuming technique in production. After the seat has been cut and the stone placed into position from the top, the prongs are then bent in the direction of the center of the stone until the prongs lie on top of the crown surfaces of the stone. The prongs are then trimmed and then polished.

However, there are compromises for the consumer in conjunction with the prong set mountings. This is due in part to the nature of the prong itself. The prong typically is an extruded form of half round or rectangularly shaped wire that extends from the girdle to the table usually at a height that is eight percent (8%) of the diameter of the stone, or half way up the main bezel facet. The prong, a key component to keeping the stone in place is however subject to misalignment, shifting, being snagged on clothing, hair or other objects and ultimately lost.

Additionally, environmental exposure for primarily colored stones and diamonds is risky. The only protection afforded the crown from side impacts are the prongs, which collectively represent twelve percent (12%) of the surface area in a typical four prong setting. Abrasion at the facet junctions, and fracturing at the girdle are typical problems associated for colored stones in "prong" mountings.

Furthermore, present "inside bezel" settings require exceptionally fine detailed workmanship by those highly skilled in the art, hence labor costs are very prohibitive in a production environment. Secondarily "prong" style mountings are inexpensive to produce but ultimately leave the consumer with problems of durability, and potential loss of investment. The present invention is an improved method for setting stones which is attractive, durable and easy to implement.

While several types of settings exist, none securely fixes a gem within a setting while maximizing the visible area of external reflection with the adjunct concentric bezel face thus enhancing the results of internal refraction too. Also, none is as easy to install as the present invention.

In accordance with these and other objects which will become apparent hereinafter, the instant invention will now be described with particular reference to the accompanying drawings.

BRIEF DESCRIPTION OF DRAWINGS

FIG. 1*a* is a top plan view of the present invention including a gem.

FIG. 1*b* is a left side perspective view of the present invention including a gem.

FIG. 1*c* is a right side perspective view of the present invention including a gem.

FIG. 1*d* is a front perspective view of the present invention including a gem.

DETAILED DESCRIPTION

The present invention is an improved setting for a gem. The invention is also a method for placing a gem in a setting.

The invention is shown as 10 in FIGS. 1*a*-1*d*. The invention is shown as used, securing a gem 12. The setting 14 surrounds the enclosed gem 12. The setting can be used for a ring; however, the setting 14 may have voids 16 or other structure for fastening the setting 14 to a bracelet (not shown), so that the setting 14 may be used for a pendant, bracelet, earring, or other form of jewelry. The setting 14 has a bezel 18 which secures the gem from coming out of the top of the setting 14. As shown, the bezel 18 is located around the circumference of the inside void in the setting 14. However, the bezel may alternatively be only a portion of the circumference.

Figure 2A:
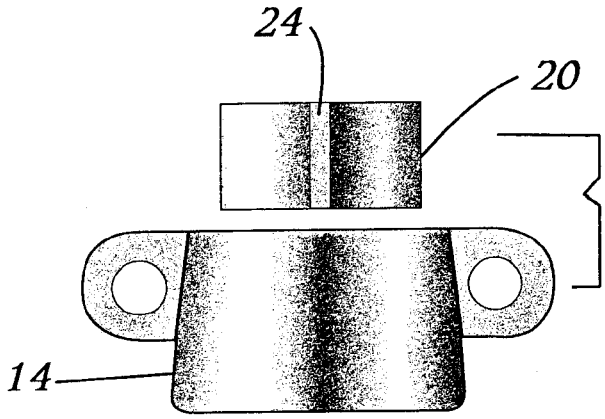
FIG. 2*a* is a side elevation view (exploded) of the invention before a gem is set.
Figure 2B:
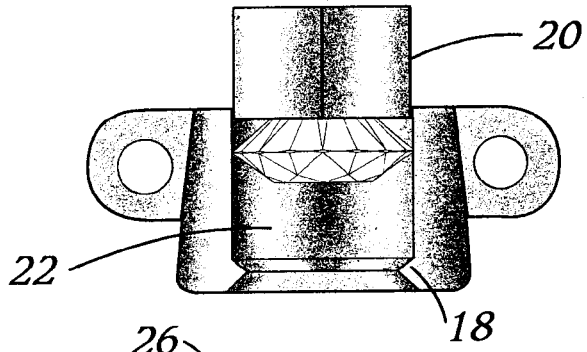
FIG. 2*b* is a side elevation view in cross section of the present invention including a gem at a point where a gem is being placed within the setting.

FIGS. 2*a*-2*e* illustrate the inventive process for securing a gem within a setting. A circular spring 20 is used to secure the gem 12 within a cavity 22 in the setting 14. As shown, the spring 20 is generally circular in shape with a gap 24 which allows the spring 20 to be compressed to fit within the circumference of the cavity 22, as illustrated in FIG. 2B. The cylindrically shaped spring 20 has a smooth exterior surface as does the passage interior surface 22 for mounting said spring in said passage and for allowing flush engagement to hold the spring anywhere in the passage to accommodate stones of different profile depths. However, the spring 20 may spiral within itself or have other configurations known in the art. Also, although the spring is shown to be cylindrical, other shapes may be preferred. The shape is dependent upon the object (stone) being secured.

Figure 2C:
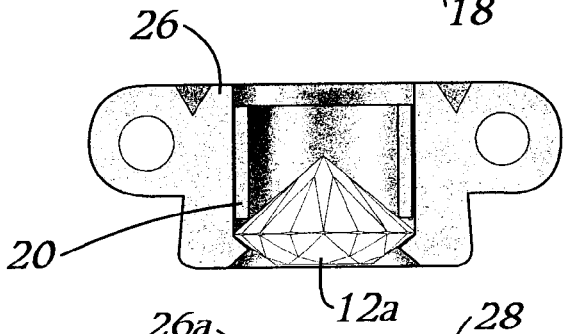
FIG. 2*c* is a cross section side elevation view of the present invention including a gem at a point after a gem is placed inside a setting and before it is secured

As shown in FIG. 2*b*, a gem is placed on the spring so that the gem is secured into the setting 14 from the bottom portion of the setting. The gem is then placed generally against the bezel 18 of the setting 14 as the spring 20 is located within the cavity 22 of the setting, as shown in FIG. 2*c*. One or more countersunk prongs 26 are located on the setting 14 so that the prongs extend beyond the bottom portion of the spring 20 when it is properly positioned inside the cavity of the setting. In the preferred embodiment, two countersunk prongs 26 are used, and are made of a bendable material, such as gold, silver or platinum.

Figure 2D:
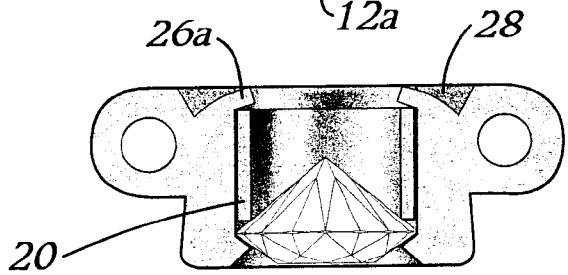
FIG. 2*d* is a cross sectional side elevation view of the present invention including a gem at a point after a gem is secured within a setting.
Figure 2E:
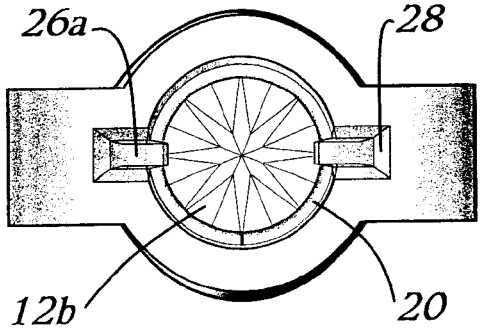
FIG. 2*e* is a bottom plan view of the present invention including a gem at a point after a gem is secured within a setting.

The countersunk prongs 26 (FIG. 2*c*) are then bent toward the center of the cavity so that the spring 20 is secured within the cavity 22 as shown in FIGS. 2*d*-2*e*. Thus, the gem 12 is secured within the setting between the bezel 18 and the spring 20. The countersunk prongs 26*a* in FIG. 2*d* make only slight, if any intrusion into the circumference of the gem beyond the spring.

Figure 3D:
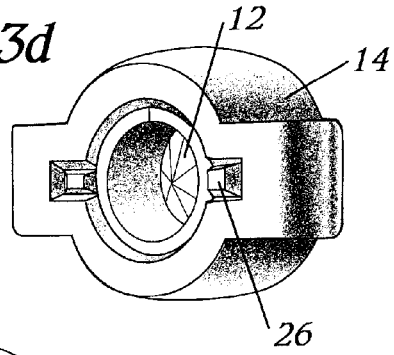
FIG. 3*d* is a bottom perspective view of the invention with a spring mount in place.
Figure 3C:
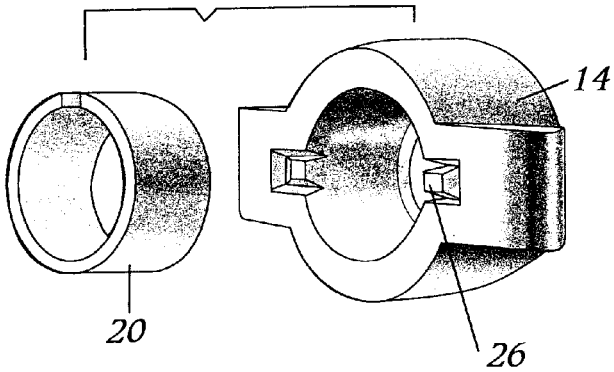
FIG. 3*c* is a side perspective (exploded) view of the invention before a gem is set.
Figure 3B:
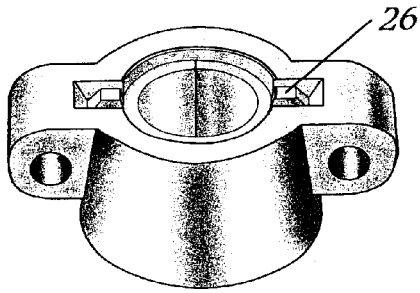
FIG. 3*b* is a bottom perspective view of the invention with a spring mount in place.
Figure 3A:
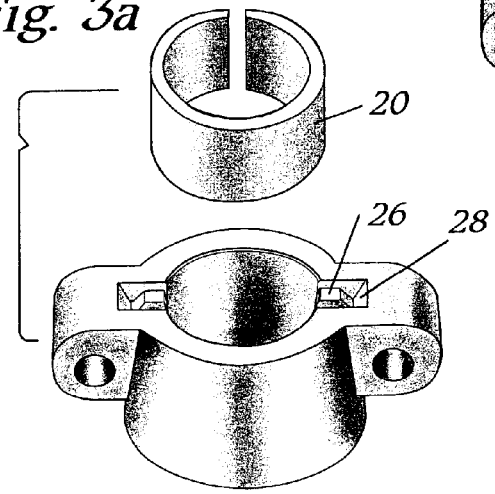
FIG. 3*a* is a bottom, perspective (exploded) view of the invention before a gem is set.
Figure 4A:
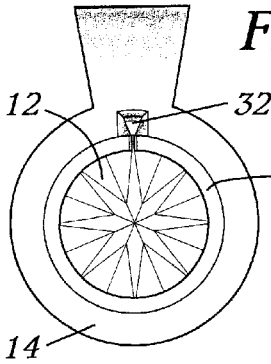
FIG. 4*a* is a bottom plan view of an alternative embodiment containing a gem.
Figure 4D:
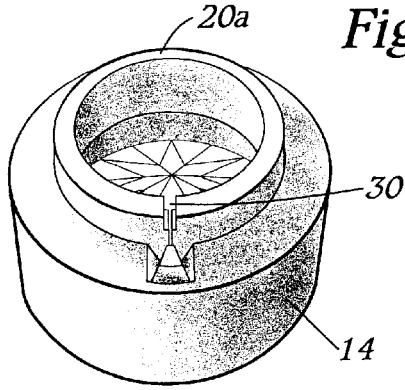
FIG. 4*d* is a bottom perspective view of an alternative embodiment.
Figure 4B:
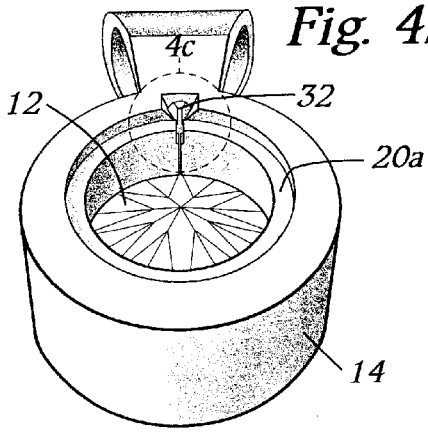
FIG. 4*b* is a bottom perspective view of an alternative embodiment containing a gem.
Figure 4E:
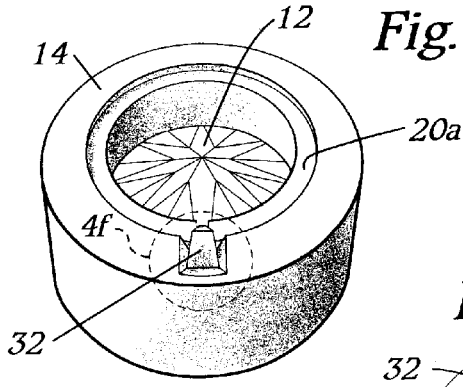
FIG. 4*e* is a bottom perspective view of an alternative embodiment at a point when a gem is inside the setting and before it is secured within the setting.
Figure 4G:
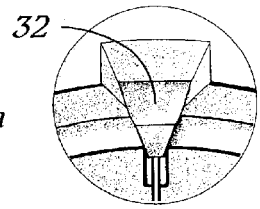
FIG. 4*g* is a (sectional) bottom enlarged cut away perspective view in detail of a fastener of an alternative embodiment after a gem is placed in the setting and secured.
Figure 4C:
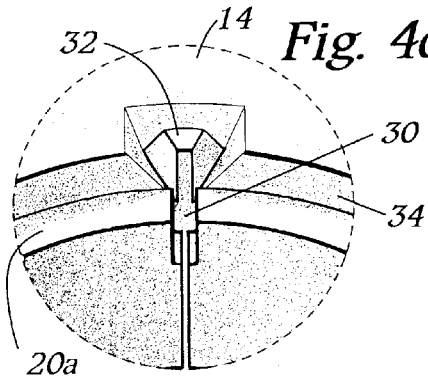
FIG. 4*c* is a (partial) bottom perspective and enlarged detail view of an alternative embodiment with the gem and spring in place.
Figure 4F:
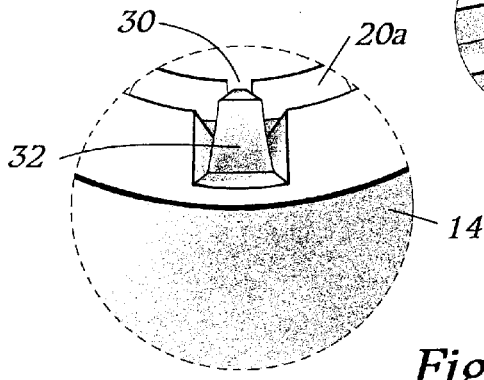
FIG. 4*f* is a (partial) bottom perspective view cut away in detail of an alternative embodiment at a point after a gem is secured within the setting.

The preferred embodiment of the setting is shown in FIGS. 3*a*-3*d*. In the preferred embodiment, the spring 20 is of a predetermined size with a predetermined gap, as shown in FIGS. 3*a* and 3*c*. In this embodiment, the size of the spring and the gap are made so that the gap 24 disappears when it is placed within the setting 14, as shown in FIGS. 3*b* and 3*d*. The spring is shown to be generally cylindrical; however, it may be of any desired shape, including generally conical, so that it engages frictionally with the inside perimeter of the cavity in the setting.

The countersunk prongs 26 are preferred to be located on the setting itself, as shown in FIGS. 3*a*-3*d*. As shown, the countersunk prongs 26 are located within a depressed area 28 in the bottom of the setting. As shown, the area 28 is chamfered; however, other shapes for the depression may be used. In addition, other shapes for the countersunk prongs are also considered in this invention. As shown, only slight movement of the countersunk prongs is necessary to secure the gem 12. Although two countersunk prongs are shown, one may be used, or, to secure the gem more surely, more countersunk prongs may be used. Also, it may be preferred that the countersunk prongs are tapered to maximize the area securing the spring and minimize any intrusion into the visible area of the gem.

An alternative embodiment is shown in FIGS. 4*a*-4*g*. In this embodiment, the spring 20 includes a spacing 30. Although it is preferred that the spacing 30 is located at the gap 24 of the spring 20, the spacer may be located anywhere on the lower portion of the spring 20. In this embodiment, the spacing 30 acts as a guide for a single countersunk prong 32. In this embodiment, several spacings may be used for several countersunk prongs. Also, as shown, the prong is tapered so that the prongs provides a wedging effect into the spacing 30 on the spring 20. The wedging effect makes the spring secure against the inner circumference 34 of the cavity 22. Thus the gem is secured tightly in the setting 14 in this embodiment.

Therefore, the invention includes a countersunk prong stone mount comprising:

an outer portion having an inside bezel over a gem for retaining the gem;

a generally circular inner spring portion located within the outer portion below the gem; and one or more mechanically bendable countersunk prongs for retaining the inner spring portion within the outer portion.

The invention is also a method for mounting a gem using countersunk prongs in a setting from the bottom of the setting, comprising the steps of:

placing the gem inside a void in an outer portion of a setting having an inside bezel located on the inner perimeter of the void, whereby the countersunk prong or prongs prevents the gem from passing through the outer portion;

simultaneously pressing down against the stone and bezel thus creating a synergetic effect in the setting of the stone "down and out;

"placing a generally circular spring under tension with a front side and a back side within the void behind the stone, so that the gem is secured by the spring between the front side of the spring and the bezel; and bending one or more countersunk prongs over the back side of the spring so that the gem and the spring are secured within the setting.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An improved selling for gem or synthetic stones for providing a self-centering permanent set for an inside bezel setting comprising:

a housing for receiving a stone in an inside bezel mounting that includes a cylindrical passage having a smooth cylindrical surface interior sized in diameter to receive a stone of substantially the same diameter regardless of its cut or shape;

a spring substantially cylindrical in shape and having a slight opening allowing a certain amount of radial compression of the spring reducing its diameter, said spring being sized to be slightly larger in diameter than the inside diameter of said stone receiving housing passage and having a smooth exterior surface;

said gemstone housing forming an inside bezel including a narrowed circular passage conical in shape with one end face of the housing passage at the inside end of the housing passage having a diameter smaller than the diameter of the gem or the passage;

a stone including a body portion that is annular and shaped to abut the interior housing passage narrowed annular area exposing the upper face of the stone from the housing in an inside bezel setting;

said spring being positioned and mounted at a desired depth inside said housing passage so to engage said stone to prevent said stone from being removed from said housing; and said gem housing including at least one countersunk bendable prong mounted near the bottom perimeter of said housing cylindrical interior passage and sized to engage a portion of said cylindrical spring to lock permanently in position and engage said stone inside said setting.

2. An improved stone setting as in claim 1 wherein:

said stone can be round, oval, or pear shaped, either faceted or cabochon and is either a gem or a synthetic stone.

3. An improved article of jewelry that includes a jewelry stone and an article of jewelry having a metal housing for providing an inside bezel setting comprising:

jewelry housing for housing a stone, said jewelry housing including a cylindrical smooth interior passage;

stone mount for retaining said stone in said jewelry housing cylindrical smooth interior passage that includes an insertable cylindrical spring having a smooth exterior surface that can be mounted at a desired depth of said housing passage, said depth being determined to accommodate the different crown-pavilion angles, girdle thickness and diameter differences that change with different stones in said passage using the compression resilience of said cylindrical spring and engaged against the stone for holding the stone in the passage;

bezel lip for preventing said stone from passing all the way through said passage exposing the top surface of the stone; and at least one prong for fastening said cylindrical spring in said housing to prevent the removal of said spring.

4. The method of creating an inside bezel mounting in an article of jewelry for use with either gem or synthetic stones comprising the steps of:

(a) selecting an article of jewelry and providing a smooth cylindrical passage through a portion of said gem housing;

(b) creating a gem housing restricted annular bezel lip smaller than the gem size to be inserted at one end of said gem stone housing in conjunction in forming a part of the passage through said gem housing;

(c) inserting a gem stone from the bottom up into said gem stone housing;

(d) inserting a cylindrical compression spring at a desired depth commensurate for that particular stone in said gem housing cylindrical passage having a smooth cylindrical exterior surface and a diameter slightly larger than the interior of the cavity to provide a seat and stop for the pavilion of the stone; and (e) providing at least one countersunk prong and bending the countersunk prong toward the center of the gem housing over the spring to a depth where the countersunk prong contacts the cylindrical spring that in turn is in contact with the said stone, respective of the total crown to bottom of the spring distance to permanently set the stone.

* * * * *